United States Patent [19]

Cress

[11] 4,005,820

[45] Feb. 1, 1977

[54] FURNACE APPARATUS AND PROCESS FOR CONTROL THEREOF

[75] Inventor: Howard D. Cress, New Haven, Ind.

[73] Assignee: Wm. E. Burford, New Haven, Ind. ; a part interest

[22] Filed: May 21, 1975

[21] Appl. No.: 579,384

[52] U.S. Cl. ..... 236/1 G; 431/20

[51] Int. Cl.[2] ..... F23N 3/00

[58] Field of Search ..... 236/45, 46, 1 G; 431/170, 20

[56] References Cited

UNITED STATES PATENTS

| | | | |
|---|---|---|---|
| 2,155,642 | 4/1939 | Dewey | 236/1 G |
| 2,367,143 | 1/1945 | Schrader | 431/170 X |
| 2,508,885 | 5/1950 | Mackay | 431/20 |
| 2,604,935 | 7/1952 | Ross | 431/170 X |
| 3,010,451 | 11/1961 | Hodgins | 236/1 G |
| 3,106,239 | 10/1963 | Jansen et al. | 431/20 X |

*Primary Examiner*—William E. Wayner
*Attorney, Agent, or Firm*—John A. Young

[57] ABSTRACT

In the heating chamber of the furnace are a number of heat-absorbing elements which serve as a thermal storage, absorbing some of the heat which is developed during the regular burning cycle and then releasing such heat for additional heating effect. Stored heat is available for additional and therefore more efficient heating. A control system is used to conserve heat by selectively and automatically opening and closing the stack to prevent heat loss in timed relation with the burning cycle and adapted to provide sufficient purge time. The stack valve opens automatically at the commencement of a burning cycle and thereafter automatically closes after a purge interval. In the event of a power failure, the stack valve automatically closes and reopens when power is restored prior to the commencement of any succeeding burning operation.

9 Claims, 10 Drawing Figures

FURNACE APPARATUS AND PROCESS FOR CONTROL THEREOF

BACKGROUND OF THE INVENTION

Because of high cost of heating dwelling places, commercial establishments and the like, it has become essential to operate heating units in a more efficient manner to conserve high price fuels. A part of the solution to this problem is the more efficient storage of heat within the burner chamber during burner operation. By storing at least a part of the heat during the periodic burning stages, it is possible to then release at least a part of the heat in a more useful manner. Thus heat can be generated and can be expended in a controlled and therefore more economical fashion.

A major time of heat loss is during the burning operation when temperatures reach their peak and it is at that stage that heat is most likely to be lost to the system. Since, however, it is proposed in the present invention to absorb a greater part of the heat during the heating cycle and then expending the heat in a useful manner, a more efficient utilization is realized in this described manner.

It has been further found, that one of the major sources of heat loss is through the stack. While it appears that one "obvious" way to solve the problem is to provide a valve in the stack which would open during the heating operation and thereafter close, this has not proved to be a very practical way of preventing heat loss because there is heretofore not been devised a practical way of coordinating stack closure and stack opening with burner operation in a manner which could insure the free passage of exhaust gases through the stack during normal burner operation, allow purging of combustion gases after burner operation and then effect closure of the stack. All this must of course be automatic and should occur with unfailing certainty and in addition, effect closure of the flue in the event of power failure and automatic opening thereof when power is restored.

Consequently, the stack is closed, and automatically, except during actual firing and purging of possibly dangerous gases within the combustion chamber.

OBJECTS OF THE INVENTION

It is a principal object of the present invention to utilize in a more efficient manner the heat energy which is developed within the combustion chamber of a furnace of both gas fired and oil fired embodiments in order to effect greater economy of fuel usage.

It is another object of the present invention to provide thermal elements which absorb heat within the combustion chamber and then release such heat in a controlled and hence more efficient manner than previously.

It is another object of the present invention to provide an automatic control system in which the stack is automatically sealed against heat loss when the burner is not in operation; when the burner is in operation the stack is always kept in an open position. When the heating system transitions from heating to non-heating, the stack is automatically held open to allow for purging of any harmful, noxious gases and the like within the heating chamber, and after such purging is completed the stack is automatically closed and kept in that condition until the heat sensor calls for resumption of heating operation at which time the stack is reopened.

It is a further object of the present invention that automatically, and in response to a power failure, that always as the burner operation is discontinued, the stack is automatically resealed.

It is an overall object of the present invention, by means of the aforementioned control device, to reduce heat losses which occur by passage of hot air and other gases out of the stack.

Other objects and features of the present invention will become apparent from a consideration of the following description which proceeds with reference to the accompanying drawings wherein a selected example embodiment is chosen to illustrate the invention but is by no means restrictive thereof.

DRAWINGS

Figure 4A:
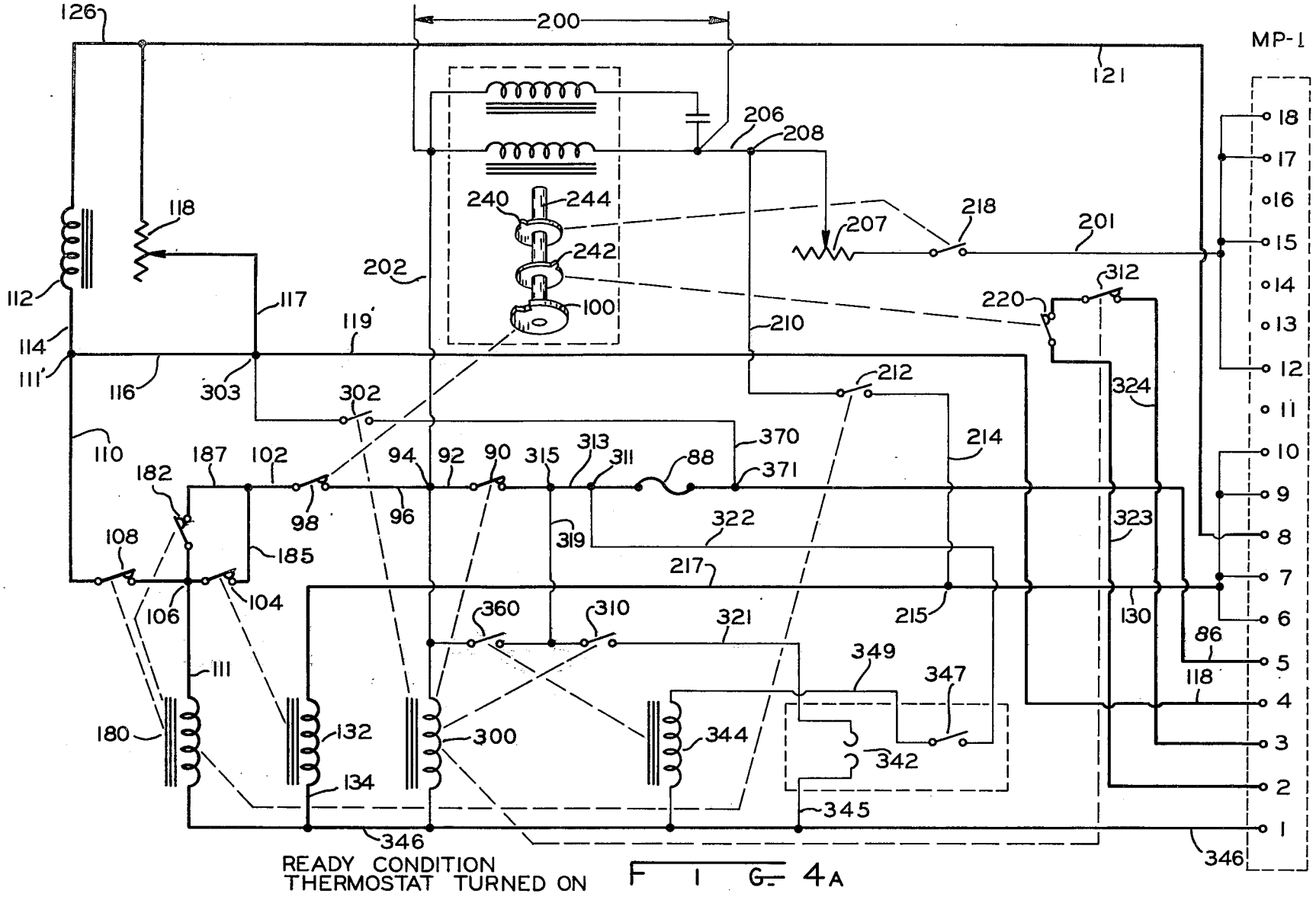
Figure 4B:
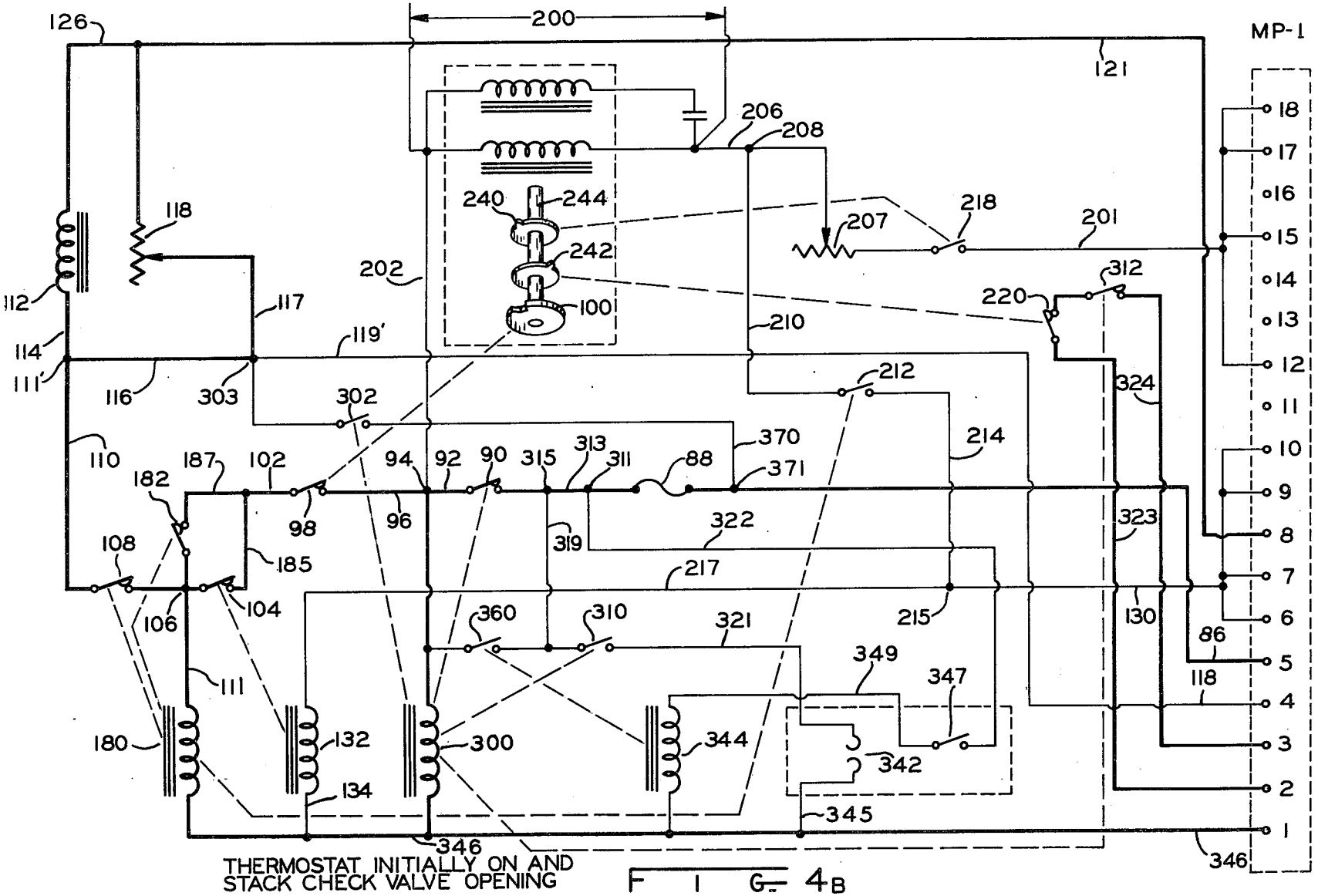
Figure 4C:
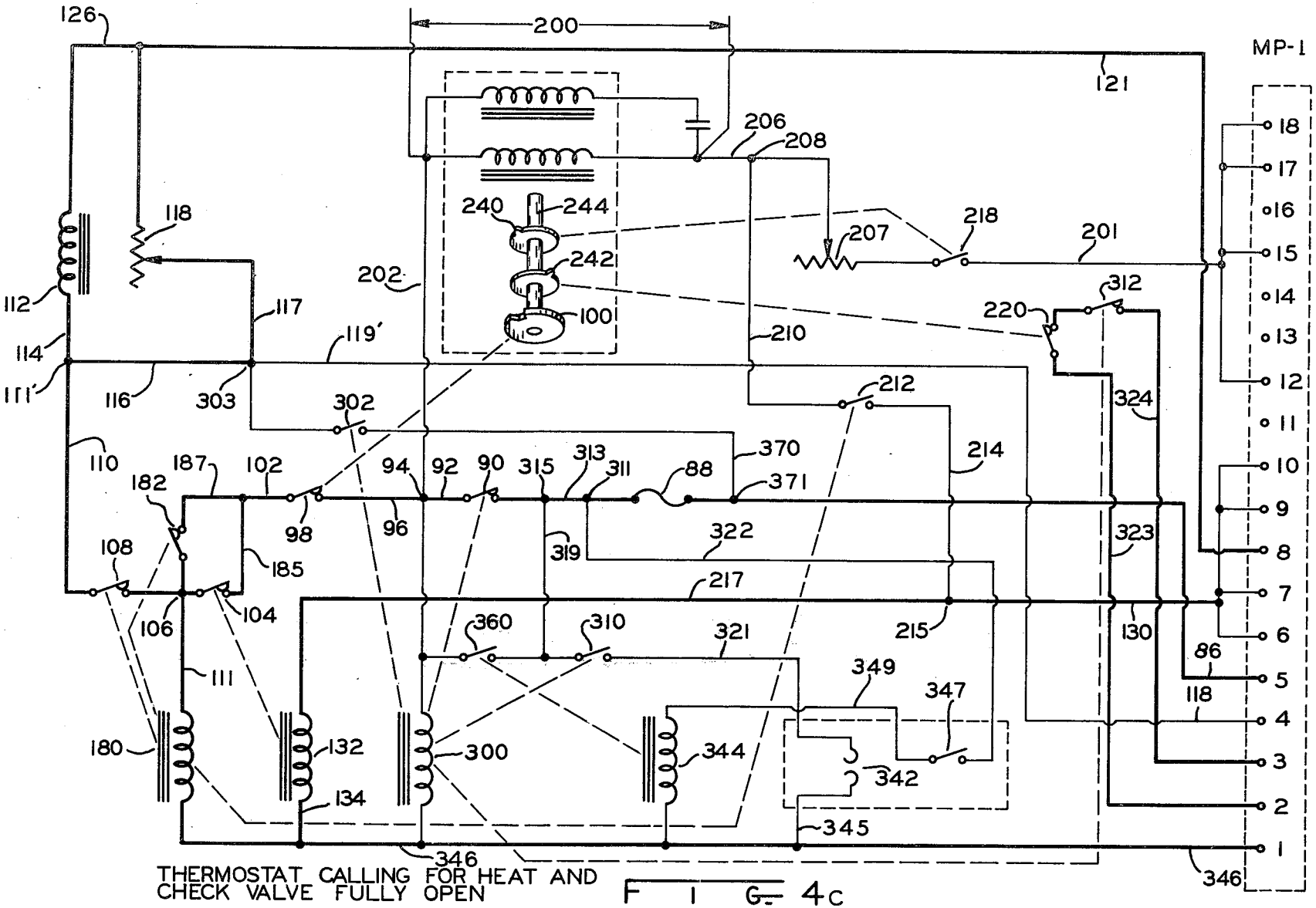
Figure 4D:
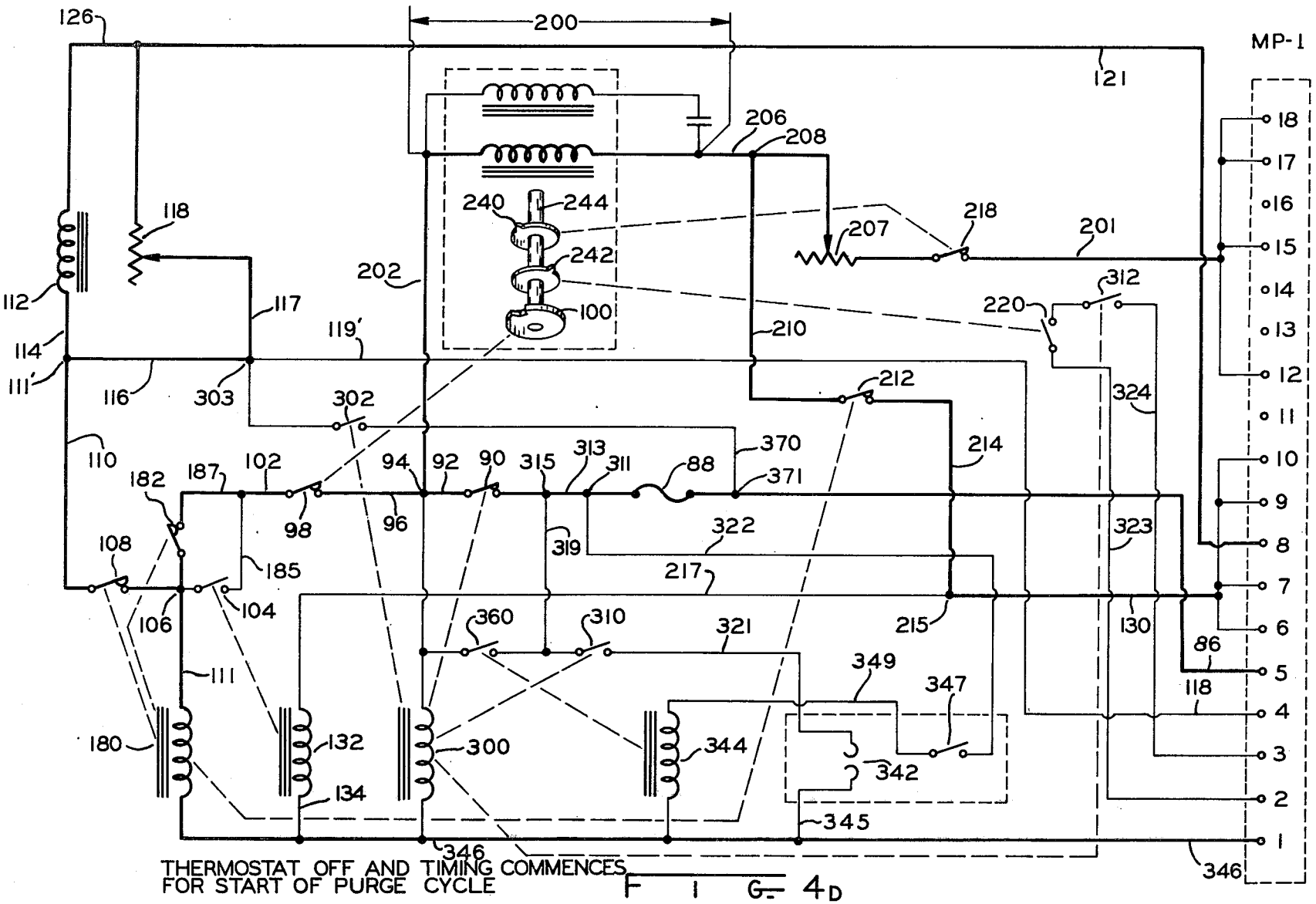
Figure 4E:
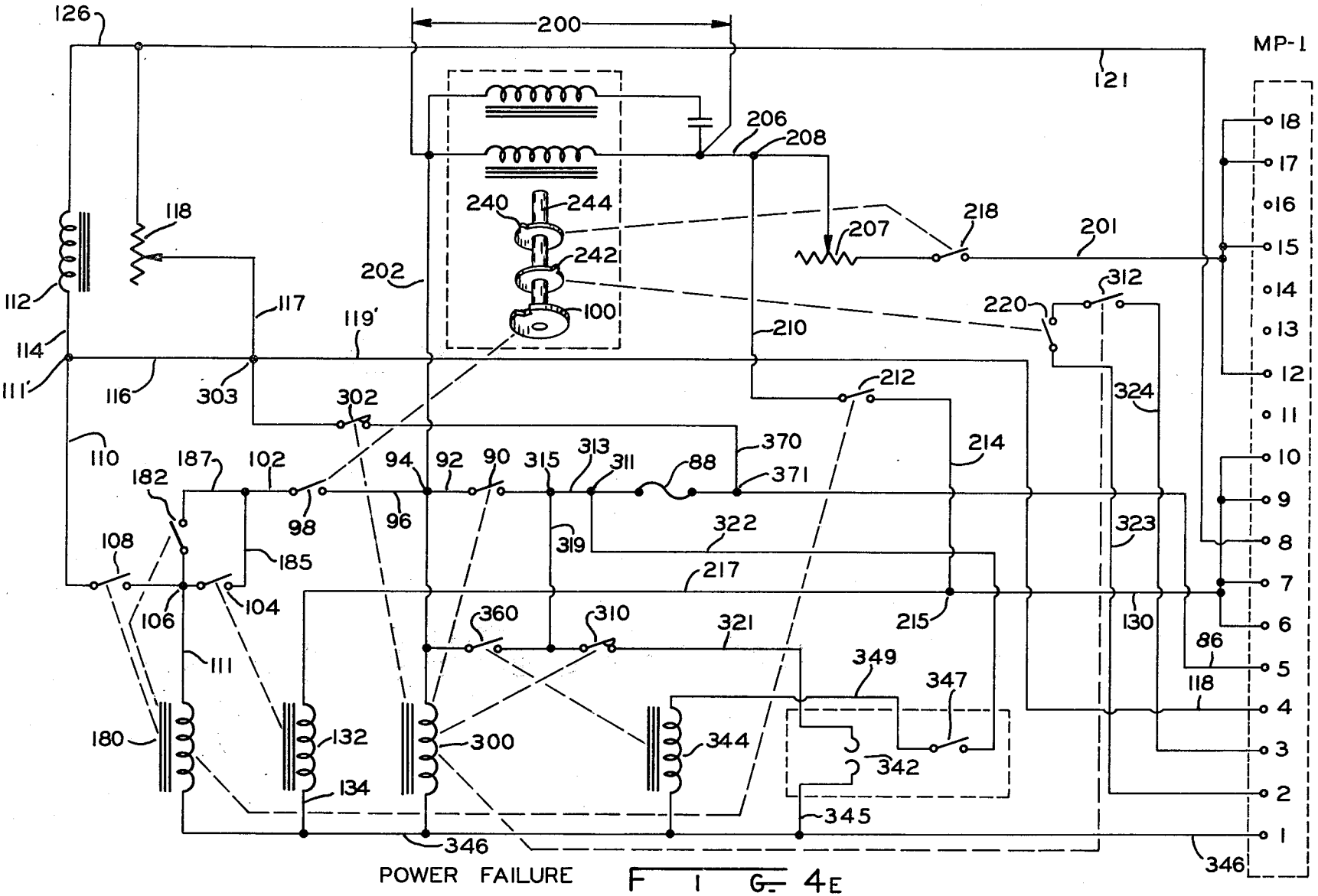
Figure 4F:
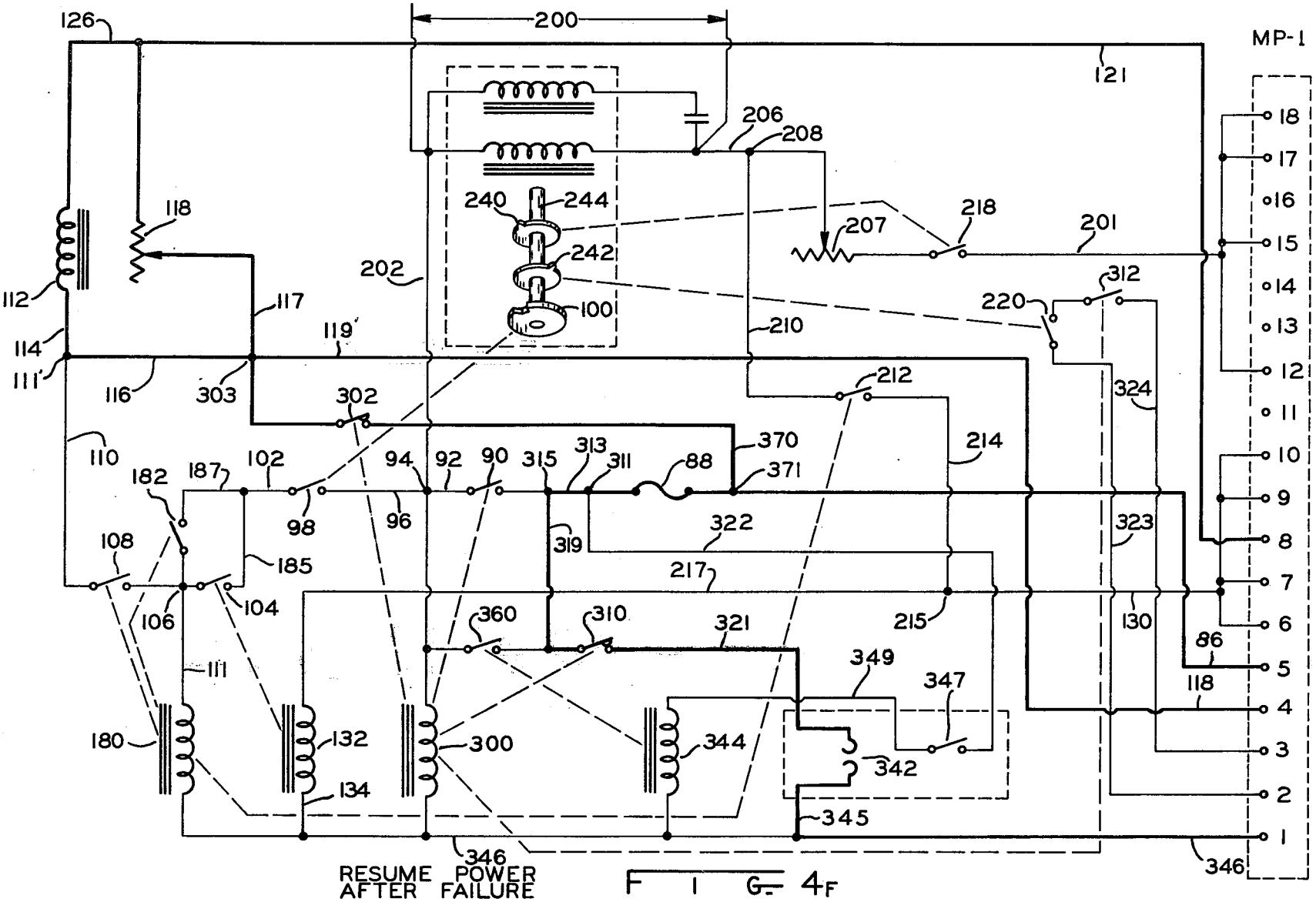

FIGS. 4*a*–4*f* illustrate the main control circuit in successive conditions wherein FIG. 4a illustrates the control circuit when the thermostat first signals need for commencement of a heating operation and the check valve in the flue is closed; FIG. 4*b* is the next successive condition from 4*a* wherein the check valve within the flue starts to open and the thermostat is still signalling need for a heating operation; FIG. 4*c* illustrates the next condition of the control circuit in which the thermostat is still open and the check valve is fully open; FIG. 4*d* illustrates the thermostat terminating the heater cycle and the timer starts to run to produce a scavenging and runout time; FIG. 4*e* illustrates a power failure or fuse-blow condition which the system is deprived of power and the burner shut off; FIG. 4*f* illustrates the condition of 4*e* after the burner comes on following either power failure of failure of the fuse from the main power system.

Figure 2:
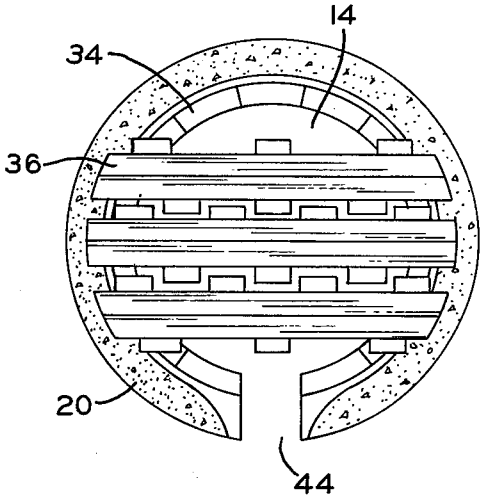
FIG. 2 is a section view taken on line 2—2 of FIG. 1.
Figure 1:
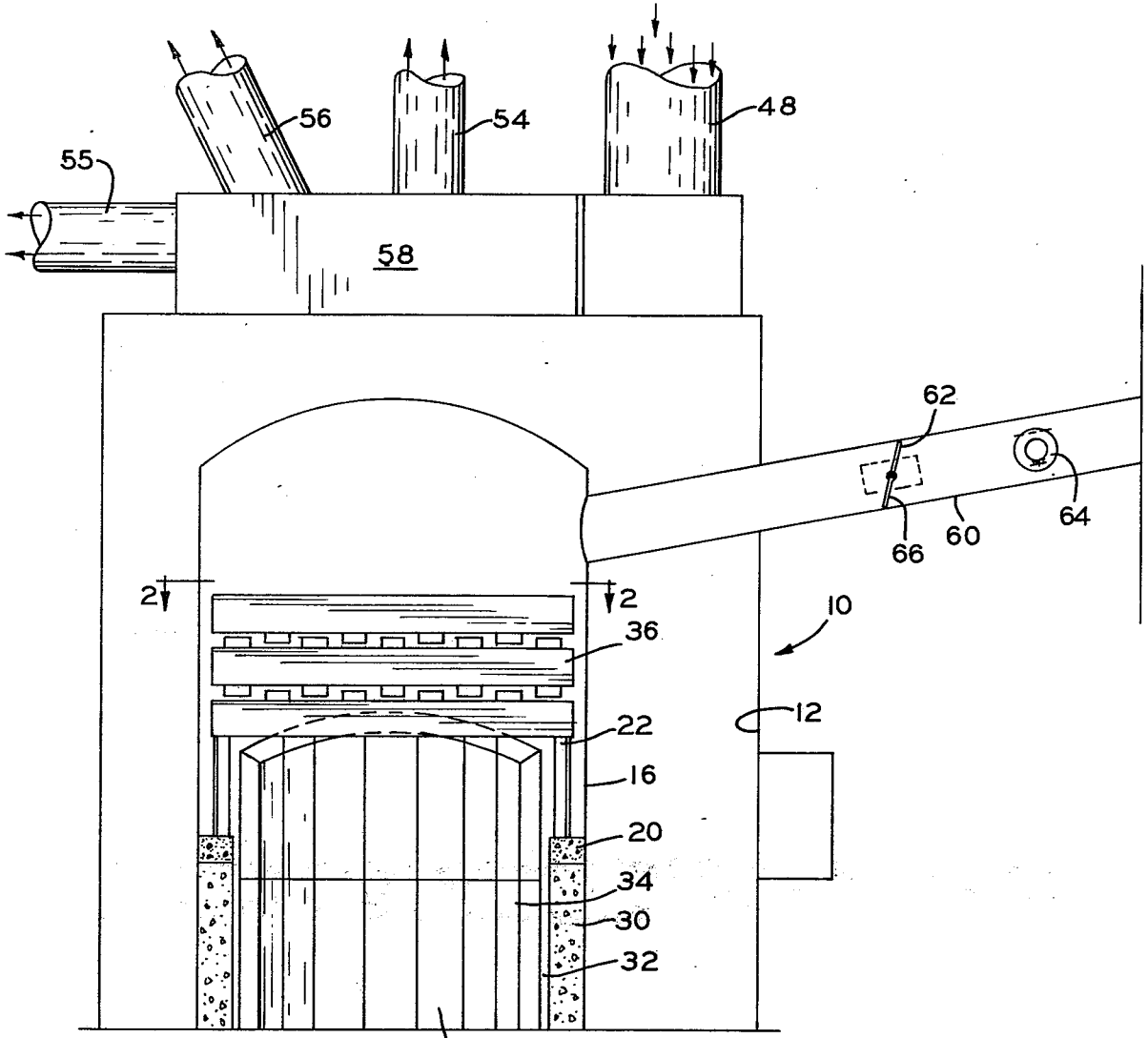
FIG. 1 is a side elevation view of a furnace shown partly in section and with the cold air ducts, heat ducts and stack incorporating the automatic check value in accordance with the present invention.
Figure 3:
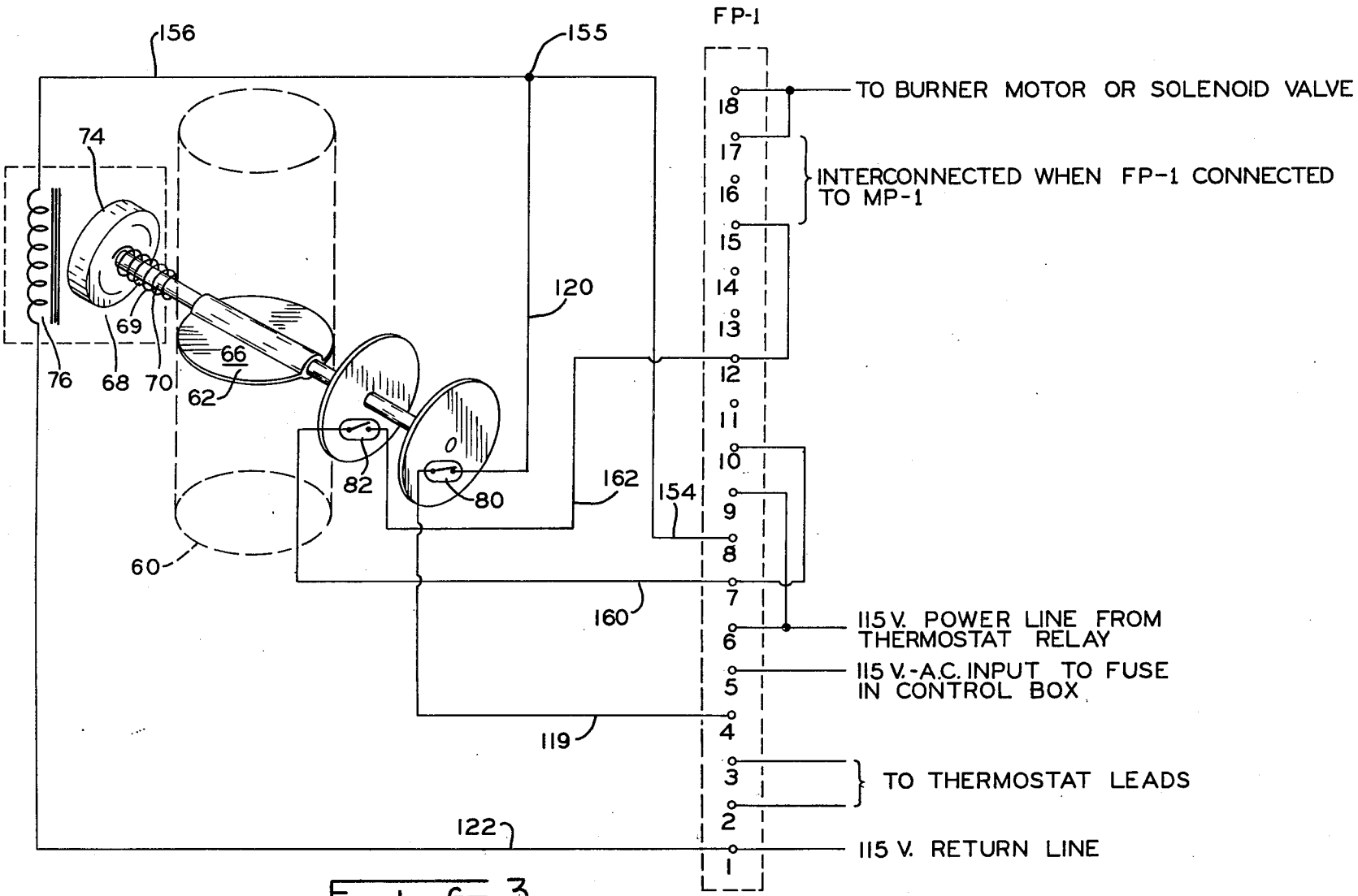
FIG. 3 illustrates details of the check valve, check valve drive motor and position switches associated with the check valve for controlling the other portions of the control circuit.
Figure 5:
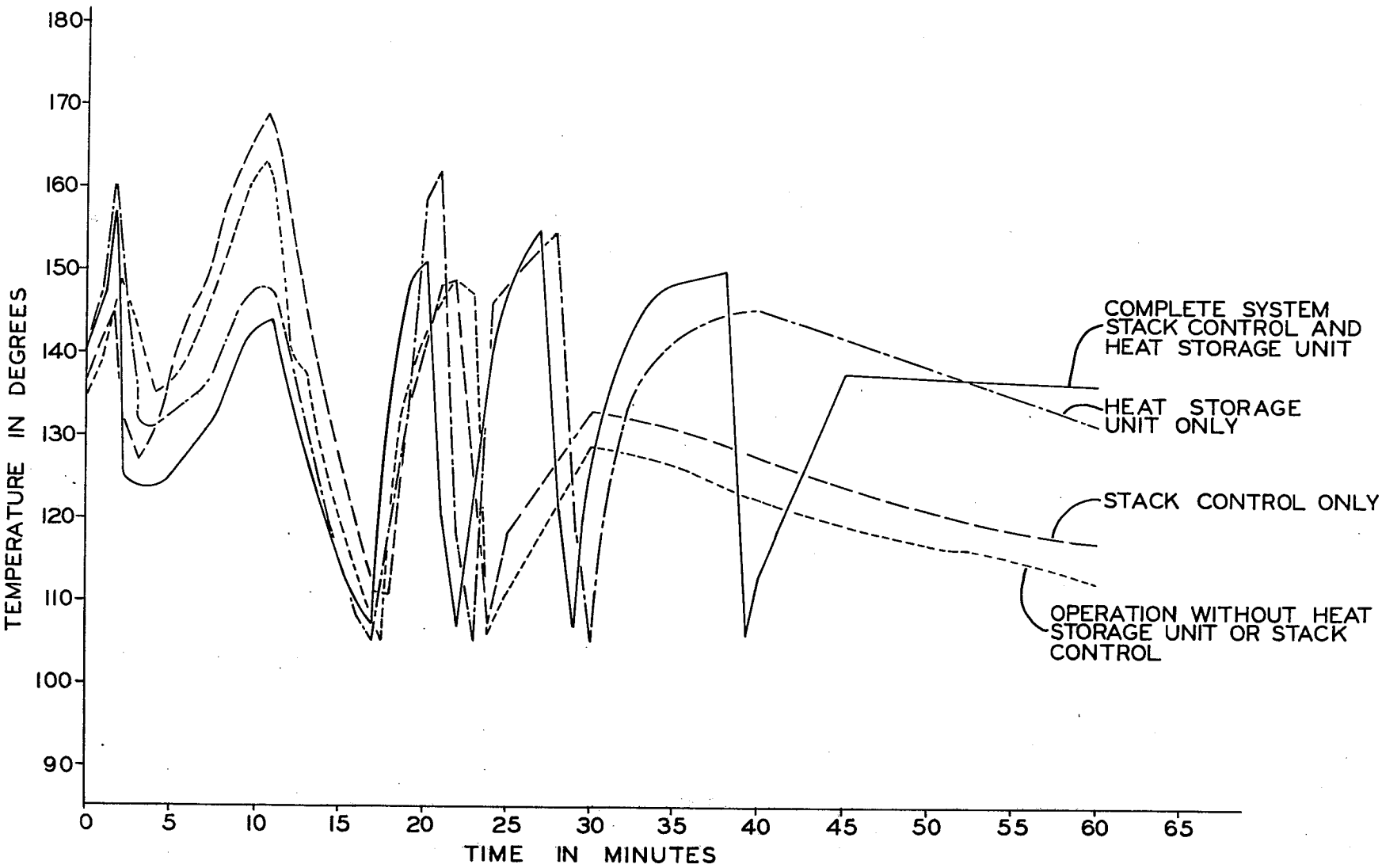

FIG. 5 illustrates the superimposed curves, Temperature versus Time in a heating chamber having neither control system or thermal inertia elements and, the next curve illustrates Temperature versus Time (same scale) of the same chamber but with a control system including a flue value which prevents heat loss through the stack; the next curve is of the same chamber but with the heat storage (heat inertia elements) in the combustion chamber of FIG. 1 and without the control valve system to prevent heat loss through the stack; and the next curve is the same heating chamber of FIG. 5 illustrating Temperature versus Time but with a heating system incorporating both the thermal storage units of FIG. 1 and the control system of FIG. 3 including the stack check valve of FIG. 2.

DETAILED DESCRIPTION OF THE INVENTION

Referring to FIGS. 1 and 3, there is illustrated a furnace 10 consisting of a sheet metal cabinet with an interior combustion chamber 14 surrounded by a jacket 16, footing 20 and a number of still support rings 22. At the lower end of the furnace is a combustion chamber 14 which may be either oil or gas fired. Surrounding the combustion chamber is a stone filler 30, a steel backing 32 and a quantity of fire brick 34. Above the footing are heat storage units 36 consisting of high heat absorption fire brick, vermiculite and the like, all of which is designed to receive a part of the heat which is generated within the combustion chamber 26, and to retain such heat after the firing operation is completed.

An opening 44 is provided for the burner which is energized and fed with combustible material in the form of gas, oil or the like.

The furnace has a cold air return 48 and heat ducts 54, 55, 56 through which hot air is circulated from the plenum 58.

The combustion product gases are vented to atmosphere through a stack vent duct 60 having an automatic check valve 62 and a barometric damper 64.

STACK CHECK VALVE

Referring to FIG. 3, the stack check valve 62 consists of a baffle or barrier 66 which is proportioned to substantially fill the cross section of the stack duct 60, the stack valve 62 being spring loaded by spring 69 to the closed position shown in FIGS. 1, 3 and is operated to an open position by means of a shaded pole driven motor 68 having a drive shaft 70 connection with the barrier or baffle 66 and includes an armature 74 and field windings 76. Also on shaft 70 are two mercury switches 80, 82 which are positioned responsive to the position of the baffle 66 such that mercury switch 80 is in closed ("on") position when the valve 66 is in its closed position and mercury switch 82 is open (position indicated in FIG. 3) when the stack valve is in the closed position shown in FIGS. 1, 3.

Certain circuits are made through the circuit of FIG. 3 to the control circuit illustrated in FIGS. 4a-4f so that the operation of the stack valve 62 coordinates with the operation of the burner under all conditions of operation.

CONTROL CIRCUIT

Referring next to FIG. 4*a*, the system is assumed to be with power, the sack valve 62 is closed, and the thermostat of the system signals the need for heat, a 115 volt line commencing with contact "5" of M-P-1 (FIG. 4*a*) through conductor 86, fuse 88, junction 311, conductor 313, the closed (normally opened) switch 90, conductor 92, junction 94, conductor 96, closed switch 98 (which is operated by a cam 100 in a manner later to be described), conductor 102 through switch 104 (which is normally open), junction 106, closed switch 108 (which is normally open), conductor 110 bypassing for the moment a high resistance 112 and conductor 114 and through conductor 116, junction 303 to conductor 118 and contact 4 in FIG. 4a of the male plug M-P-1.

From contact 4 FIG. 4a power is transmitted through female plug F-P-1 through contact 4, conductor 119, closed mercury switch 80, conductor 120 through the winding 76 of the shaded pole motor and the 115 volt return line 122 through contact 1 of F-P-1 to ground on the return side.

It is the action of the thermostat switch from contact 6 and 7 which closes the normally open switch 104 enabling the circuit described. Switch 104 closes because the thermostat switch through contact 6 and 7 acts through conductor 130, junction 215, conductor 217, relay 132 and conductor 134 to ground line 122 is energized to relay 132, conductor 134, ground 346, contact 1 of M-P-1 to effect closing of the normally open switch 104.

The switch 104 will remain closed to enable the circuit described by the control circuit through contacts 4 and 5 of M-P-1 until the thermostat relay is "off". When switch 104 is closed the relay 180 is energized through conductor 111 to ground 346, closing switches 108, 182 and 212. When the circuit is made as shown in FIG. 4a, power is communicated to the shaded pole motor (FIG. 3) (F-P-1) which will operate the check valve 62 to an open position. Once the shaded pole motor 68 moves the stack valve 62 to a full open position, the mercury switch 82 is then closed and mercury switch 80 opens and the circuit to the motor 68 is then next made in the same manner from contact 5, M-P-1 (FIG. 4a) through the same circuit as described, but commencing at conductor 110, through conductor 114, resistance 112 (consisting of 0.7 Henry and 250 ma), conductor 126 to contact 8 of M-P-1 FIG. 4*b*. From contact 8 of M-P-1 (FIG. 4*b*) contact is made through contact 8 of F-P-1 (FIG. 3) through conductor 154, junction 155, conductor 156, shaded pole motor windings 76 to ground line 122 and ground contact 1 (F-P-1). Thus much lower voltage is communicated to motor 68 keeping the valve 66 open against the spring force tending to close it.

BURNER TURN ON

The effect of closing the switch 82 and opening switch 80 with the check valve 66 now in full open position, is to energize the burner motor or solenoid valve in the case of gas operated furnace, this burning operation will continue as long as the thermostat signals the need for heat.

Referring to FIG. 4*b* the stack check valve 66 is kept open against the spring force tending to hold 66 in a normally closed position by means of contacts 5 to 8 (FIG. 4b) through resistance 112 and therefore the circuit to the shaded pole motor is through conductor 154, 156, junction 154 (FIG. 3) to ground line 122.

At the same time that the secondary circuit is made through contact 8 (FIG. 3) a power connection is made to the burner motor through contact 7 (FIG. 3), conductor 160 through closed mercury switch 82 and conductor 162 to contact 12 which is coupled to contacts 15, 17 and 18 when F-P-1 and M-P-1 are connected to make contact with the burner motor. Thus, in the conditions of FIG. 4*b* when the thermostat continuously calls for heat, and the check valve 66 is oepn, the burner motor will continue to actuate the oil burner or the solenoid valve and combustion will continue within the combustion chamber 14 heating the heat storage units 36 (FIGS. 1, 2) and the furnace will continue to distribute heat through the heat ducts 54, 55 and 56 with the cold air returning for recycling through duct 48. In the stack conduit 60 the automatic check value 62 will continue to open under the described conditions.

THERMOSTAT OPENS

When the thermostat opens, the first thing that happens is that the burner discontinues operation but the valve 62 continues to remain open for a "purging stage" in the manner next to be described and in connection with FIGS. 4*b*, 4*c*, 4*d*. Commencing first with FIG. 4*b*, when the thermostat switch is opened through contact 7 the relay 132 is de-energized and the normally open switch 104 is opened. The moment the thermostat switch opens, the relay 132 permits the normally open switch 104 to open. Once the burner is shut off (which occurs automatically when the thermostat opens), the potential across the clock circuit 200 (FIG. 4c, 4d) is 115 volts, when the burner is shut off because the circuit from conductor 201 to contacts 6, 7, 9 and 10 is disabled, but when the burner is on there is 0 potential across the clock circuit 200. Thus, the clock circuit becomes operative commencing from the time when the burner is shut off by thermostat operation and a circuit is then created across the clock circuit commencing from contact 5, conductor 86, fuse 88, junction 311, conductor 313, junction 315, closed switch 90, conductor 92, junction 94, conductor 202 across the timing circuit 200, conductor 206, junction 208, conductor 210, closed switch 212 (which is normally open) conductor 214, junction 215, conductor 130 and contacts 6, 7, 9 and 10. Once the clock timer commences operation (FIG. 4d) the switch 218 is immediately closed and switch 220 is immediately opened, switches 218 and 220 being operated by means of cams 240 and 242 carried by shaft 244 of the clock drive mechanism.

Switch 98 is opened after approximately one minute by means of the cam 100 also on the shaft 244 and this causes the valve 66 to close. The delay in closing valve 66 enables the gases to be purged, this being commonly referred to as the scavenger time, i.e., time permitting the combustion chamber 14 to be emptied of noxious and other dangerous gases before the flue is closed to confine the chamber 14 against further heat loss.

Referring to FIG. 4c, a circuit continues to be made through contact 5, conductor 86, fuse 88, closed switch 90 (which is normally open), conductor 92, junction 94, conductor 96 and closed switch 98 until the closed switch 98 is opened by cam 100. Once the switch 98 is opened, however, this interrupts the circuit to shaded pole motor 68 through open switch 98, conductor 102, switch 182, junction 106, switch 108, conductor 110, conductor 114, resistance 112, conductor 121 and 126 to contact 8. The spring associated with valve 62 thus returns the valve 62 to closed position. The timer, however, continues to time (FIG. **4*d*) and to operate for an additional period of time as for example one minute only, this being referred to as the runout time and at the end of that period, switch 98 again closes by operation of the cam 100. During runout a circuit is made by contact 5, conductor 86, fuse 88, switch 90, conductor 92, junction 94, conductor 202, timer 200, conductor 206, junction 208, resistance 207, switch 218, conductor 201 and contacts 12, 15, 17 and 18** of M-P-1.

Switch 218 which at the beginning is open, is closed instantly at the time the clock drive commences by cam 240 and reopens at the end of the full timing cycle in order to permit a full runoff time and then terminates same. The circuit is made through switch 218, inasmuch as switch 212 is open when the relay 180 is de-energized by opening of switch 98 at the end of the one minute cycle by cam 100. The switch 220 opens instantly at the start of the cycle and is closed by operation of cam 242 at the very end of the cycle. The purpose of this is to disable the thermostat circuit until a complete timing cycle has run.

POWER FAILURE

Referring next to FIG. 4e, in the event of a power failure, there is a failure at contact 5 thus de-energizing the relay 300 and permitting closing of the normally closed switch 302 and 310. The normally open switch 90 is then opened and this has the immediate effect of closing the stack valve 62 thus preventing any circuit to the shaded pole motor either through contact 8 or through contact 4 to hold the valve open against the spring force biasing it closed. Thus, the first thing that happens is shutting the burner off, closing of the entire system, and immediate closure of the stack valve. In addition to the normally closed switch 302 closing, the normally open switch 90 opens, normally closed switch 310 closes, and normally open switch 312 opens. Thus, the thermostat is disabled, so that the thermostat cannot be reset by the opening of switch 312 and for a purpose which will next be explained so that when the power circuit comes on again there will be a delay preceded by opening of the stack valve.

When power is reinstituted, a circuit is made through the power line commencing from contact 5, conductor 86, fuse 88, junction 311, conductor 313, junction 315, conductor 319, closed switch 310 to the thermal relay 342 which after a three minute interval closes switch 347. A slave relay 344 is operated by thermal relay 342 through conductor 322, closed switch 347 (closed by 342) conductor 349 to relay 344 to effect closing of switch 360 which operates solenoid 300 closing the normally open switch 90, opening the normally closed switch 302, opening the normally closed switch 310 and closing the normally open switch 312. Because switch 302 is initially closed, a circuit is made upon initial power restoration through contact 4, conductor 86, conductor 370, switch 302, conductor 114 and conductor 118 to contact 4, resistance 112, conductor 121, 126 contact 8, conductor 154 (FIG. 3), conductor 156, winding 76, return 122 to energize the motor and open valve 66. Thus during the interval that power first comes on and the thermal relay timer, the motor to the valve 66 is operated but discontinues when switch 302 is opened by thermal relay 342 operation. The result is that a venting of gases from chamber 14 first occurs before any other event and then the system is ready for normal re-operation. Depending upon whether the thermostat is opened or closed, the burner will be operated and the valve 66 opened or closed in the previously described manner.

OPERATION

In operation, the control system and heat reservoir are intended for use with an intermittently operative gas or oil fired furnace. Referring to FIG. 5 which compares the invention usage with a furnace having neither the thermal storage elements or the control for the flue valve, it will be seen by comparing the curves which refer to a heating chamber of one or both or neither of the storage and control means that a combination of both the thermal storage units and the flue valve control will effect savings of 25% to 30% in fuel. That is, comparing the curves of the chamber both the check valve and the heat elements, it will be seen that the invention is effective for providing its same heating effect in a home with the same thermostat setting at a saving in furnace operation of between 25% and 30% of the fuel requirement for that furnace. This economy of operation will become clear from a consideration of the following more detailed description of operation.

During operation, heating within the burner chamber 14 will develop within about 15 to 30 minutes a cherry red condition of the heat storage units 36 (also referred to hereinbefore as heat inertia or heat flywheel elements). These units are in the nature of refractory brick or iron grating. Any material is satisfactory so long as it meets the functional requirement of having a high specific heat and is able to withstand exposure to the heat within heating chamber 14 without deterioration or excessive contraction and expansion.

Because the heat storage elements 36 receive heat and are available to give off the same heat following termination of the burner operation, it is possible to more efficiently utilize the heat which would otherwise be lost to the system.

Referring next to the control system which effects operation of the check valve 62 in an automatic manner whereby said check valve 62 is closed when the burner is deacturated and is opened during the burner operation with provision for purging of the combustion chamber for a specified period of time in the interval between deactuation of the burner and closing of the stack in order to rid the combustion chamber of explosive or otherwise noxious gases. A further safety feature of the valve operation is that it will automatically close should the system loose power and will automatically be reopened before the burner can commence reoperation once power is restored to the system. How these events occur will be next described.

In operation, referring to FIG. 4*a*, there will be described the condition when the thermostat signals a requirement for heat and the check valve 66 is in a closed position. It should be understood from referring to the male plug M-P-1 indicated in FIG. 4*a*, contacts 2 and 3 are associated with the thermostat circuit contacts 13, 14 and 16 are non-operative, contacts 6, 7, 9 and 10 constitute a part of the power line from the thermostat. Contact 5 is the power circuit, contact 1 is the return. Contacts 4, 8, 12, 15, 17 and 18 are interconnecting terminals. The reason for multiple contacts is to serve as a safety against overload conditions.

When the thermostat switch is closed a circuit is made through contacts 6, 7, 9 and 10 (FIG. 4*a*) through conductor 130 energizing relay 132 through the windings thereof and conductor 134 to the 115 volt return line 346. Relay 132 then closes normally open switch 104. A circuit is then made from the power line commencing with contact 5 conductor 86 through fuse 88, junction 311, conductor 313, junction 315, closed switch 90, conductor 92, junction 94, closed switch 98, conductor 102 through closed switch 104, junction 106 through the winding of relay 180 to ground 346 which in turn effects closing of switches 108 and 182 and closing switch 212. When switch 182 is closed a circuit is made through conductor 187 and closed switch 182 as well as through conductor 185 and closed switch 104 to junction 106, closed switch 108, conductor 110, 116, junction 303, conductor 118, contact 4 (FIG. 3), conductor 119, switch 80, conductor 120, motor 96, ground line 122.

The shaded pole motor 68 then turns the valve 66, against the resistance of the spring (not shown) about shaft 70 until it reaches a full open position whereupon the switch 80 opens and switch 82 closes. At this point the valve 66 becomes held in open position against the resistance of the spring by means of a much lower magnitude voltage as will be next described.

The circuit through contact 4 (F-P-1, FIG. 3) is broken because switch 80 opens in full open position of the valve 66 and therefore a new contact must be made between power line contact 5 of FIG. 4a (M-P-1) and this is accomplished by means of a circuit commencing with contact 5 through conductor 86, fuse 88, closed switch 90, conductor 92, junction 94, closed switch 98, either conductor 102, conductor 185 or conductor 187 and closed switches 104 or 182 to junction 106, closed switch 108, conductor 110, junction 111, conductor 114 through choke 112 or conductor 116, conductor 117, resistance 118 through conductor 121 and to contact 8 M-P-1 and then to F-P-1 contact 8 (FIG. 3). From contact 8 (F-P-1, FIG. 3) a circuit is made through conductor 154, winding 76 of the shaded pole motor to the ground 122 but the voltage and current which are transmitted to the shaded pole motor in this case is of much lower magnitude but sufficient to overcome the resistance of the spring tending to bias the valve 66 to a closed position and thus the valve is held in open position against the resistance of the spring by the lower magnitude of power communicated to the shaded pole motor.

At this time, whereas the mercury switch 80 becomes open and mercury switch 82 is closed, it should be clear that these two switches 80, 82 are position responsive mercury switches depending upon the condition of the valve 66, i.e., when valve 66 is closed switch 80 is closed and when valve 66 is open switch 80 is open and valve 82 becomes closed. When switch 82 is closed, a circuit is made from contact 7 (note that contacts 6, 7, 9 and 10 are all connected from power line from the thermostat relay and provides 115 volts, contact 5 leading to a 115 volt AC input in the control box).

When the thermostat calls for heat and the check valve 66 is open (referring to FIG. 4*b*) a circuit is made through contacts 6, 7, 9 and 10 M-P-1 to F-P-1 through conductor 160 (FIG. 3), closed switch 82, conductor 162 to contacts 12, 15 which are also connected to 17 and 18 through M-P-1 to contacts 17 and 18 of F-P-1 thereby energizing the burner.

This condition continues until the thermostat opens at which time (referring to FIG. 4*c*), immediately upon the thermostat opening the burner is deactuated by means of a circuit (not shown) which is part of the conventional control system.

Once this occurs, as indicated in FIG. 4*c*, a clock circuit designated generally by reference numeral 200 immediately has 115 volt potential across the timer.

Because of the potential which exists across the timer immediately upon deactuation of the burner the clock drive 200 is caused to operate since a potential exists in the line commencing from contact 5 through conductor 86, fuse 88, junction 311, conductor 313, junction 315, closed switch 90, conductor 92, junction 94, conductor 202 across the timer 200, conductor 206, junction 208, conductor 210, closed switch 212, conductor 214, junction 215, conductor 130 and one or the other of the burner contacts 6, 7, 9 or 10. During this time, a circuit continues to be made from contact 5 through contact 8 as well, to the shaded pole motor 76 maintaining the valve 66 in an open position.

The timer which includes three cams 240, 244 and 100 operating switches 218, 220 and 98 respectively, operates in such way that normally closed switch 220 is opened to disable the thermostat circuit commencing from contact 3 and conductor 324, closed switch 312, open switch 220 and conductor 323 back to connector 2.

The switch 220 is open until an entire cycling period for the timer motor and after such is completed the switch 220 is again closed which occurs at the end of the full timing period.

Switch 218 which is at the beginning open, is immediately closed by cam 240 and is held closed until the end of a complete clock cycle at which time it again opens to terminate the clocking circuit (note that after the purge cycle, which is much shorter than the total cycle, cam 100 causes switch 98 to open disabling the motor 76 and allowing valve 66 to close). After one minute of timing cycle which is known as the purging cycle, the switch 98 is opened thus disabling solenoids 132 and 180 opening the normally open switches 104, 198, 182 and 212. Because switch 218 remains closed, however, the timer continues to time through connector 5, conductor 86, fuse 88, junction 311, conductor 313, junction 315, closed switch 90, conductor 92, junction 94, conductor 202 across the timer 200, conductor 206, junction 208, resistance 207, closed switch 218, conductor 201 to one or the other of connectors 12, 15, 17 or 18 of M-P-1. The timer continues to run until an entire cycle is completed at which time switch 218 opens and the timing cycle is finished.

Referring to FIGS. 4e and 4f, if a power failure should occur or if fuse 88 should not operate, relays 180, 132, 302 are all disabled, the normally opened switches 108, 182 and 104 are opened, normally closed switch 302 closes, the normally closed switch 310 closes, the normally open switch 90 opens, the normally open switch 212 opens and the normally open switch 312 opens. Thus, the thermostat circuit is disabled, the burner is turned off, and the stack valve 66 is immediately biased to a closed position by the operation of the spring, thereby closing switch 80 (FIG. 3) and opening switch 82.

Referring now to FIG. 4f, when power is resumed, power from contact 5 (M-P-1) as shown in FIG. 4f creates a circuit from conductor 86, junction 371 through conductor 370, closed switch 302, junction 303 to conductor 119, contact 4 of M-P-1 to contact 4 of F-P-1 through conductor 119 (FIG. 3), switch 80, conductor 120, winding 76 of the shaded pole motor and ground line 122 thus causing the valve 66 to be biased against the resistance of the spring to an open position.

A circuit is also made from contact 5 through conductor 86, junction 371, fuse 88, junction 311, conductor 313, junction 315, conductor 319, normally closed switch 310, conductor 321 to the thermal switch 342 which, after an interval closes and completes the contact through 347 to the ground 346. A slave relay 344 then closes, making a circuit through junction 311, conductor 322, closed switch 347, conductor 349 to relay 344 closing switch 360 which is normally open, energizing relay 300 to close normally open switch 312 in the thermostat line, open normally closed switch 310, and open the normally closed switch 302, permitting the valve 62 to close. The circuit is now returned to the circuit condition indicated in FIG. 4a which is the circuit condition prevailing at the time the check valve is closed and in the event that a thermostat signals restart, the operation repeats as indicated described in FIGS. *4a*, *4b*.

The operation of the thermal storage elements and the control system described improves the furnace operation, conserving heat to the extent of 25% to 30%, while maintaining the same thermostat setting. This result is indicted from the curves indicated plotting temperature verus time in FIG. 5.

Although the present invention has been illustrated and described in connection with a few selected example embodiments, it will be understood that these are illustrative of the invention and are by no means restrictive thereof. It is reasonably to be assumed that those skilled in this art can make numerous revisions and adaptations of the invention and it is intended that such revisions and adaptations will be included within the scope of the following claims as equivalents of the invention.

What is claimed is:

1. In a process for controlling the heat losses in a heating system, the steps comprising monitoring the temperature within a given area with a temperature responsive element, communicating to a check valve within an exhaust stack below demanded temperature conditions to effect opening of such check valve to a position preliminary to operating a burner switch energizing a burner within a furnace to develop temperature to a preferred level, thereafter maintaining the burning until the temperature reaches a preferred value and is sensed by said temperature responsive element to effect an unswitching action which terminates burner operation, and then communicating to a check valve motor through a time delay device, said check valve including two oppositely acting position responsive switch means, each operatively associated with said check valve to effect closing of said valve after a predetermined time to a closed position and wherein said valve is closed to define a switch action which actuates a control system wherein said check valve remains closed and will maintain such position to conserve heat within said furnace following sensing by the temperature responsive element of the preferred temperature.

2. The process in accordance with claim 1 including the step of continuously sensing any condition of electrical power loss to effect termination of burner operation and immediate closing of said check valve.

3. The process in accordance with claim 1 including the step of heating, during the normal heating cycle, a plurality of thermal inertia elements within the combustion chamber whereby, when the burner operation is terminated and check valve closed, usable heat is deliverable from said thermal inertia elements by fan operation.

4. The process in accordance with claim 1 including the step of sensing any power failure of the electrical system, closing the check valve responsively to said power failure, and automatically reopening such check valve upon resumption of power.

5. The process in accordance with claim 4 including the step of immediately disabling the burning operation upon power failure and precluding the reoperation of said burner until the check valve has been opened by a predetermined period.

6. An apparatus for conserving heat comprising a heating chamber with direct combustion operation, a stack, and an automatic check valve disposed within said stack and adapted to move between open position providing passage of gaseous material through said stack and closed position wherein gases are prevented from passing through said stack to conserve heat within said heating chamber, thermostat control means having an operative connection with said stack check valve to effect opening thereof at a critical temperature prior to commencement of heating operation, at least two oppositely acting position responsive switch means each operable by the positioning of said check valve and adapted to control both the heating element for said heating chamber and for actuating the control circuit controlling said stack check valve means operatively responsive to said heat responsive element at the upper limit of temperature adapted to de-energize said heating means, and adjustable clock means for commencing a predetermined adjustable time interval following termination of heating and fixing the time interval before which said check valve is reclosed.

7. The apparatus in accordance with claim 6 including means for disabling the burner in the heating chamber during a power failure and means for opening the stack valve upon resumption of power and before the burner can re-commence operation.

8. The apparatus in accordance with claim 6 including a thermal-responsive delay means for initially opening the check valve after power failure and for automatically effecting closure thereof after a predetermined time in the event that heating operation is not re-commenced.

9. The process for conserving heat within a heating system comprising the steps of generating heat by burning operation with a chamber, opening and closing a check valve within the stack in timed relation with burner operation whereby the stack is closed during a non-heat developing cycle within the heating chamber to conserve heat within said chamber following burning operation, continuously sensing the position of said check valve by means of two oppositely acting position responsive switches to effect actuation and de-actuation of a control system for operating said check valve and additionally operatively controlled by said heating operation, automatically opening the check valve during heating operation, and maintaining for adjustably controlled periods a temporary purge cycle following the termination of each heating operation to provide purging of combustion products through the stack at the end of the burning cycle following which the check valve is closed by a control circuit effective through one of said position responsive switches.

* * * * *